US005932517A

United States Patent [19]

Wen et al.

[11] Patent Number: 5,932,517

[45] Date of Patent: Aug. 3, 1999

[54] THERMAL DYE TRANSFER PROCESS

[75] Inventors: Xin Wen; Teh-Ming Kung; David A. Johnson, all of Rochester, N.Y.

[73] Assignee: Eastman Kodak Company, Rochester, N.Y.

[21] Appl. No.: 08/995,687

[22] Filed: Dec. 22, 1997

[51] Int. Cl.[6] ..... B41M 5/035; B41M 5/38

[52] U.S. Cl. ..... 503/227; 428/195; 428/913; 428/914

[58] Field of Search ..... 8/471; 156/235; 428/195, 913, 914; 503/227

[56] References Cited

U.S. PATENT DOCUMENTS

| | | | |
|---|---|---|---|
| 4,668,239 | 5/1987 | Durand | 8/471 |
| 5,523,274 | 6/1996 | Shuttleworth et al. | 503/227 |
| 5,534,479 | 7/1996 | Shuttleworth et al. | 503/227 |
| 5,627,128 | 5/1997 | Bowman et al. | 503/227 |

*Primary Examiner*—Bruce H. Hess
*Attorney, Agent, or Firm*—Harold E. Cole

[57] ABSTRACT

A process of forming a dye transfer image comprising:

a) imagewise-heating a dye-donor element comprising a support having thereon a dye layer comprising a dye dispersed in a polymeric binder, the dye being a deprotonated cationic dye which is capable of being reprotonated to a cationic dye having a N–H group which is part of a conjugated system, b) imagewise transferring the dye to a dye image-receiving layer of a dye-receiver element which contains acid moieties capable of reprotonating the deprotonated cationic dye, and c) subjecting the dye-receiver element to heat from a heat source immediately prior to, during, or after the imagewise transfer of the dye.

10 Claims, No Drawings

THERMAL DYE TRANSFER PROCESS

CROSS REFERENCE TO RELATED APPLICATIONS

Reference is made to commonly-assigned U.S. patent application Ser. No. 08/927,782 entitled "Improved Resistive Thermal Printing Apparatus and Method Having a Non-Contact Heater" of Wen et al., filed Sep. 11, 1997.

FIELD OF THE INVENTION

This invention relates to a thermal dye transfer process wherein the dye-donor element contains a deprotonated cationic dye and the receiver element contains an acid species capable of reprotonating the deprotonated cationic dye.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye-receiver polymer should have good affinity for the dye and provide a stable (to heat and light) environment for the dye after transfer. In particular, the transferred dye image should be resistant to image degradation by contact with other surfaces, chemicals, fingerprints, etc. Such image degradation is often the result of continued migration of the transferred dyes after the printing step.

Commonly used dyes are nonionic in character because of the easy thermal transfer achievable with this type of compound. The dye-receiver layer usually comprises an organic polymer with polar groups to accept the dyes transferred to it. A disadvantage of such a system is that, since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

DESCRIPTION OF RELATED ART

U.S. Pat. Nos. 5,523,274; 5,534,479 and 5,627,128 relate to the transfer of a deprotonated cationic dye to a dye image-receiving layer containing an organic acid moiety as part of a polymer chain or which contains an acid which is capable of reprotonating the deprotonated cationic dye. There is a problem with this process in that the protonation rate is not as fast as one would like it to be.

It is an object of this invention to provide a thermal dye transfer process employing a deprotonated cationic dye which has an enhanced protonation rate. It is another object of this invention to provide a thermal dye transfer process employing a deprotonated cationic dye which will accomplish the desired protonation process within a short period of time.

SUMMARY OF THE INVENTION

These and other objects are achieved in accordance with this invention which relates to a process of forming a dye transfer image comprising:

a) imagewise-heating a dye-donor element comprising a support having thereon a dye layer comprising a dye dispersed in a polymeric binder, the dye being a deprotonated cationic dye which is capable of being reprotonated to a cationic dye having a N–H group which is part of a conjugated system, b) imagewise transferring the dye to a dye image-receiving layer of a dye-receiver element which contains acid moieties capable of reprotonating the deprotonated cationic dye, and c) subjecting the dye-receiver element to heat from a heat source immediately prior to, during, or after, e.g., within about 2–3 minutes, the imagewise transfer of the dye.

DESCRIPTION OF THE PREFERRED EMBODIMENTS

Deprotonated cationic dyes useful in the invention which are capable of being reprotonated to a cationic dye having a N–H group which is part of a conjugated system, are described in the U.S. Pat. No. 5,523,274 referred to above.

In a preferred embodiment of the invention, the deprotonated cationic dye employed in the invention and the corresponding cationic dye having a N–H group which is part of a conjugated system have the following structures:

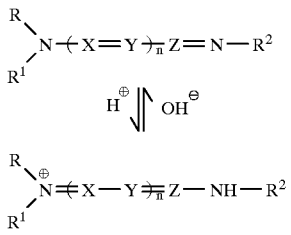

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents a substituted or unsubstituted phenyl or naphthyl group or a substituted or unsubstituted alkyl group from about 1 to about 10 carbon atoms; and n is an integer of from 0 to 11.

The deprotonated cationic dyes according to the above formula are disclosed in U.S. Pat. Nos. 4,880,769; 4,137,042 and 5,559,076, and in K. Venkataraman ed., *The Chemistry of Synthetic Dyes*, Vol. IV, p. 161, Academic Press, 1971, the disclosures of which are hereby incorporated by reference.

Any type of polymer may be used in the dye-receiver employed in the process of the invention, e.g., condensation polymers such as polyesters, polyurethanes, polycarbonates, polyamides, etc.; addition polymers such as polystyrenes, vinyl polymers, etc.; block copolymers containing large segments of more than one type of polymer covalently linked together; provided such polymeric material contains acid groups either as part of the polymer chain or as a separately added organic acid. In a preferred embodiment of the invention, the dye image-receiving layer comprises a polyester, an acrylic polymer, a styrene polymer or a phenolic resin.

The dye image-receiving layer of the dye-receiver employed in the process of the invention contains an organic acid, such as a sulfonic acid, a carboxylic acid, a phosphonic acid, a phosphoric acid, or a phenol as part of the polymer chain, or it may contain a separately added organic acid. The polymeric dye image-receiving layer acts as a matrix for the deprotonated dye and the acid functionality within the dye image-receiving layer will concurrently cause reprotonation and regeneration of the parent cationic dye. For various ways in which acid moieties can be incorporated into a dye-receiver, reference is made to U.S. Pat. Nos. 5,523,274; 5,534,479 and 5,627,128, the disclosures of which are hereby incorporated by reference.

Organic acids which can be separately added to the polymer to provide its acidic nature generally comprise ballasted organic acids, e.g., carboxylic acids, such as palmitic acid, 2-(2,4-di-tert-amylphenoxy)butyric acid, etc.; phosphonic/phosphoric acids such as monolauryl ester of phosphoric acid, dioctyl ester of phosphoric acid, dodecylphosphonic acid, etc.; sulfonic acids such as hexadecanesulfonic acid, p-octyloxybenzene-sulfonic acid; a phenol such as 3,5-di-tert-butyl-salicyclic acid, etc.

Inorganic acids may also be added to the dye-receiving layer to provide its acidic nature. There may be used, for example, hydrated transition metals or metalloid salts of a strong acid such as those materials disclosed in U.S. Pat. No. 5,789,343 by Guistina et al. In a preferred embodiment, aluminum sulfate or zinc nitrate is used.

Specific examples of dyes useful in the invention include the following (the λ max values and color descriptions in parentheses refer to the dye in its protonated form):

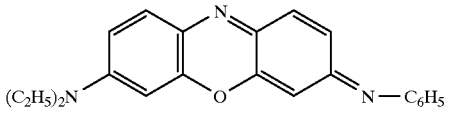

Dye 1
λ max 556 nm (641 nm)
magenta (cyan)
U. S. Pat. 4,880,769 (Dye 1)

-continued

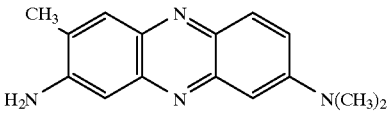

Dye 2
λ max 459 nm (536 nm)
yellow (magenta)

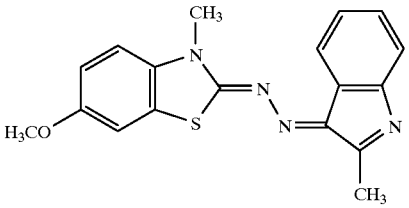

Dye 3
λ max 459 nm (522 nm)
yellow (magenta)

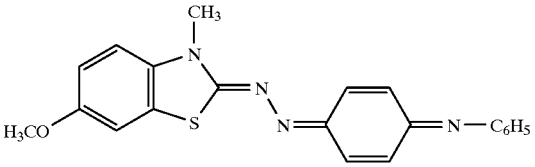

Dye 4
λ max 503 nm (621 nm)
red (blue)

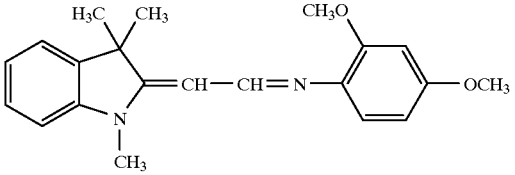

Dye 5
λ max 379 nm (405 nm)
yellow (yellow)

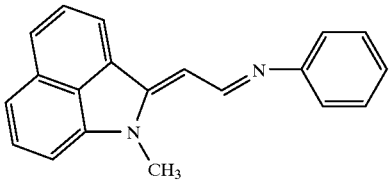

Dye 6
λ max 479 nm (513 nm)
yellow (magenta)

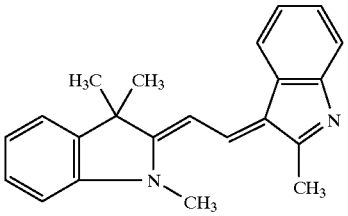

Dye 7
λ max 485 nm (495)
yellow (yellow)

-continued

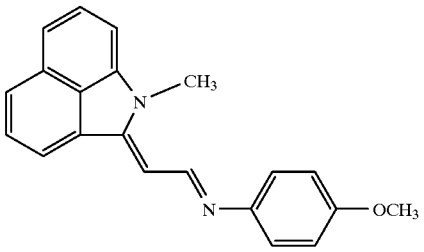

Dye 8
yellow (magenta)
U.S. Pat. 5,559,076 (dye precursor 5)

The dyes described above may be employed in any amount effective for the intended purpose. In general, good results have been obtained when the dye is present in an amount of from about 0.05 to about 1.0 g/m$^2$, preferably from about 0.1 to about 0.5 g/m$^2$. Dye mixtures may also be used.

The following dye-receiver polymers may be used in accordance with the invention:

| | |
|---|---|
| P-1 | poly(butyl acrylate-co-2-acrylamido-2-methyl-propanesulfonic acid) 75:25 |
| P-2 | poly(2-ethylhexyl acrylate-co-2-acrylamido-2- methyl-propanesulfonic acid) 75:25 |
| P-3 | poly(2-ethylhexyl methacrylate-co-2-acrylamido-2-methyl-propanesulfonic acid) 75:25 |
| P-4 | poly(2-hexyl methacrylate-co-2-acrylamido-2-methyl-propanesulfonic acid) 75:25 |
| P-5 | poly(butyl acrylate-co-methacrylic acid) 75:25 |
| P-6 | poly(butyl acrylate-co-2-acrylamido-2-methyl-propanesulfonic acid-co-methyl 2-acrylamido-2-methoxyacetate) 65:25:10 |
| P-7 | poly(hexyl methacrylate-co-2-sulfoethyl methacrylate-co-2-acrylamido-2-methoxyacetate) 65:25:10 |
| P-8 | polystyrenesulfonic acid |
| P-9 | poly(ethyl methacrylate-co-2-sulfoethyl methacrylate) 75:25 |
| P-10 | poly(methyl methacrylate-co-2-sulfoethyl methacrylate) 75:25 |
| P-11 | N-15 Novolak (a phenolic resin, Eastman Chemical Co.) |
| P-12 | 3.23 g/m$^2$ Poly(2-phenylethyl methacrylate) (Scientific Polymer Products Inc.) containing 0.54 g/m$^2$ of 3,5-di-t-butylsalicylic acid |
| P-13 | poly(butyl acrylate-co-allyl methacrylate-co-2-sulfoethyl methacrylate, sodium salt) 93:2:5 wt. core/poly(glycidyl methacrylate) 10 wt. shell, (Tg = −40° C.) |
| P-14: | poly[isophthalatic acid-co-5-sulfoisophthalic acid, sodium salt (90:10 molar ratio) -diethylene glycol (100 molar ratio)] |
| P-15: | poly(ethyl acrylate-co-fluoroalkyl methacrylate-co-2-acrylamido-2-methyl-propanesulfonic acid, sodium salt) (50:45:5 wt ratio) |

The polymer in the dye image-receiving layer may be present in any amount which is effective for its intended purpose. In general, good results have been obtained at a concentration of from about 0.5 to about 10 g/m$^2$. The polymers may be coated from organic solvents or water, if desired.

Heat may be employed in the process of the invention by any suitable manner. For example, there may be employed heated fuser rollers as disclosed in U.S. Pat. No. 4,966,464, the disclosure of which is hereby incorporated by reference. Other methods of heating are disclosed in the co-pending U.S. Ser. No. 08/927,782 referenced above. This application describes a resistive head thermal printer which features, in addition to the conventional components of such a printer, an auxiliary heater unit for heating the dye-receiver element. In particular, this auxiliary heater unit may be a radiant-type heater, and it heats the dye-receiver element within the printer in a non-contact mode immediately prior to, during, or immediately after the thermal dye transfer process.

Heat is employed in the process of the invention to thermally accelerate the dye conversion process taking place when a nonionic dye precursor transferred from a suitable donor element is protonated to become a cationic dye species when it reaches the dye-receiving layer of the receiver element, where it picks up a proton from an acidic moiety present in the dye-receiving layer. As a consequence, the transferred dye is securely anchored in the dye-receiving layer. The protonation reaction also brings about a hue shift in the transferred dye species.

In a preferred embodiment of the invention, the heating step in the process employs the radiant heater as described in the above co-pending U.S. Ser. No. 08/927,782. The radiant heater can be approximately 22 cm long and 1.5 cm wide, and can be arranged across the width of a page-size receiver of approximately 22 cm×28 cm. A printer transport mechanism can transport the dye-receiver so that it is subjected to heat radiated from the heater in approximately 3.8 sec. The energy density received by the dye-receiver from thermal radiation is approximately 8.7 J/cm$^2$.

In general, the temperature range suitable for the process of this invention must be chosen in such a way that the dye-receiving element is subjected to enough thermal energy as to significantly enhance the dye conversion (reprotonation) rate; yet, the temperature of the heat-treated dye-receiving element must not be such as to result in undesirable blister formation. A suitable temperature range for the application of radiant heat to a thermal dye-receiving element of the type envisioned here was determined to be from about 50° C. to about 95° C.

The support for the dye-receiving element employed in the invention may be transparent or reflective, and may comprise a polymeric, synthetic, or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 $\mu$m to 1000 $\mu$m Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239; and 4,965,241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal print heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

Dye-donor elements used in the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

In a preferred embodiment of the invention, a dye-donor element is employed which comprises a poly(ethylene terephthalate) support coated with sequential repeating areas of at least one of the dyes, as described above, capable of generating a cyan, magenta or yellow dye image and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements employed in the process of the invention are available commercially. There can be employed, for example, a Fujitsu Thermal Head (FIP-040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB 2,083,726A.

When a three-color image is to be obtained, the assemblage described above is formed on three occasions during the time when heat is applied by the thermal print head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

The following acid sources were used in the experimental work:

A-1: poly[isophthalic acid-co-5-sulfoisophthalic acid, ammonium salt(90:10 molar ratio) -diethylene glycol (100 molar ratio)], Mw=20,000

A-2: $Al_2(SO_4)_3 \cdot 18\ H_2O$

Preparation of Dye Donor Elements

Individual dye-donor elements were prepared by coating the following compositions in the order listed on a 6 $\mu$m poly(ethylene terephthalate) support:

1) a subbing layer of Tyzor TBT®, a titanium tetrabutoxide, (DuPont Company) (0.13 g/m$^2$) coated from 1-butanol/propyl acetate (15/85 wt. %); and
2) an imaging dye layer coated from a tetrahydrofuran/cyclopentanone (95/5) solvent mixture, whereby two different binder polymer mixtures with dyes 1 and 5 as shown in Table 1 were used:
   DB-1 bisphenol A epichlorohydrin copolymer (phenoxy resin from Scientific Polymer Products, Inc.);
   DB-2 poly(butyl methacrylate-co-Zonyl TM®) (50/50 wt. %) where Zonyl TM® is a perfluoro monomer available from DuPont.

TABLE 1

| Dye | Dye Laydown, g/m$^2$ | DB-1 Laydown, g/m$^2$ | DB-2 Laydown, g/m$^2$ |
|---|---|---|---|
| 5 | 0.28 | 0.27 | 0.07 |
| 1 | 0.15 | 0.18 | 0.05 |

On the back side of each dye-donor element were coated the following layers:

1) a subbing layer of Tyzor TBT®, a titanium tetrabutoxide, (DuPont Company) (0.13 g/m$^2$) coated from 1-butanol/propyl acetate (15/85 wt. %); and
2) a slipping layer of 0.38 g/m$^2$ poly(vinyl acetal) KS-1 (Sekisui Chemical Co. Ltd.), 0.022 g/m$^2$ Candelilla wax dispersion (7% in methanol), 0.011 g/m$^2$ PS513 amino-terminated polydimethylsiloxane (Huels) and 0.0003 g/m$^2$ p-toluenesulfonic acid coated from a 3-pentanone/distilled water (98/2) solvent mixture.

Preparation of Dye-Receiving Elements

A subbing layer coating solution for the dye-receiving elements used was prepared by dissolving Prosil® 221 (an aminopropyl-triethoxysilane) and Prosil® 2210 (an amino-functional epoxysilane) (both from PCR Corp.) (each at 0.055 g/m$^2$) in an ethanol/methanol/water solvent mixture. The resulting test solution contained approximately 1% silane component, 1% water, and 98% 3A alcohol.

A paper core was then extrusion laminated with a 38 $\mu$m thick microvoided composite film (OPPalyte® 350TW, Mobil Chemical Co.) as disclosed in U.S. Pat. No. 5,244,861 to form a receiver support. The above subbing layer solution was then coated onto the support at a total dry coverage of 0.11 g/m$^2$. Prior to coating, the support had been subjected to a corona discharge treatment at approximately 450 joules/m$^2$.

The following dye-receiving elements were each coated onto the support prepared as described above:

Receiver Element E-1

The dye-receiving layer consisted of a coating of a mixture of 2.42 g/m$^2$ of acid source A-1, 0.10 g/m$^2$ succinic acid, and 3.42 g/m$^2$ of polymer P-13, 0.09 g/m$^2$ of styrene/butyl acrylate/divinylbenzene beads, as well as 0.02 g/m$^2$ SYN FAC® 8216 surfactant (available from Milliken Chemical Company), and was coated from distilled water.

Receiver Element E-2

The dye-receiving layer of this element consisted of a mixture of 0.53 g/m$^2$ of acid source A-2, 2.88 g/m$^2$ P-13, 1.45 g/m$^2$ P-14, 0.22 g/m$^2$ P-15, and 0.48 g/m$^2$ each of SYN FAC® 8216 surfactant and Camauba wax ML-160 (available from Michelman Company). This mixture was coated from distilled water.

Preparation and Evaluation of Thermal Dye Transfer Images

Eleven-step sensitometric thermal dye transfer images were prepared from the dye-donor and dye-receiving elements. The dye side of the dye-donor element of approximately 10 cm×15 cm in area was placed in contact with the receiving-layer side of a dye-receiving element of the same area. This assemblage was clamped to a stepper motor-driven, 60 mm diameter rubber roller. A TDK Model No. L-231 thermal print head with a resolution of 5.4 dots/mm, thermostated at 25° C. was used. The print head was pressed with a force of 24.4 Newtons (2.5 kg) against the dye-donor side of the assemblage, pushing the assemblage against the rubber roller.

Imaging electronics were activated causing the donor-receiver assemblage to be drawn through the print head/roller nip at 38.3 mm/sec. Coincidentally, the resistive elements in the thermal print head were pulsed for 127.75 μsec/pulse at 130.75 μsec intervals during a 4.575 msec/dot printing cycle (including a 0.391 msec/dot cool-down interval). A stepped image density was generated by incrementally increasing the number of pulses/dot from a minimum of 0 to a maximum of 32 pulses/dot. The voltage supplied to the thermal print head was approximately 12.0 volt resulting in an instantaneous peak power of 0.289 watt/dot and a maximum total energy of 1.18 mJ/dot. The relative humidity in the print room was approximately 44% RH.

For images containing a cyan dye (cyan or green image), the rate of protonation is proportional to the rate of hue shift from the deprotonated cyan dye form (magenta) to the protonated cyan dye. This hue shift was monitored by measuring Status A red (cyan) and green (magenta) densities at various time intervals and calculating the red/green ratio for each time interval. Complete protonation (conversion) of the cyan dye was equivalent to the red/green ratio after incubating prints at 50° C./50% RH for 3 hours, and the percentage of dye conversion could be calculated.

After printing, the dye-donor element was separated from the image-receiving element. The Status A reflection red and green densities at maximum print density in the stepped-image were measured for the cyan and green channels using an X-Rite 820 reflection densitometer (X-Rite Corp.).

After approximately 2 to 3 minutes waiting at room temperature, the prints were exposed to radiant heat at different levels using a radiant heater. The surface temperature on the receiver was measured and found to be in the range of approximately 65° C. to 85° C. The red and green densities were then read again by the X-Rite 820 reflection densitometer. A red/green (R/G) ratio (minus the baseline) was calculated for the cyan and green images in each receiver for different heat treatments and the percent dye conversion for the cyan dye in the cyan and green images was calculated assuming the incubated R/G ratios represented 100% dye conversion. The results are summarized in Table 2 below.

TABLE 2

EFFECT OF RADIANT HEATING ON DYE CONVERSION RATE

| Receiver | Treatment | Cyan Channel | | Green Channel | |
|---|---|---|---|---|---|
| Elements | Description | R/G | % dye conv. | R/G | % dye conv. |
| E-1 | no radiant heat exposure | 2.58[1] | 50%[4] | 1.22 | 23% |
| | radiant heat at 81° C. | 4.96[2] | 95% | 4.26 | 80% |
| | 50° C./50% RH, 3 hrs.* | avg. 5.21[3] | | avg. 5.34 | |
| E-1 | no radiant heat exposure | 2.58 | 50% | 1.26 | 24% |
| | radiant heat at 79° C. | 4.70 | 90% | 4.26 | 80% |
| | 50° C./50% RH, 3 hrs. | avg 5.21 | | avg. 5.34 | |
| E-1 | no radiant heat exposure | 2.50 | 48% | 1.24 | 23% |
| | radiant heat at 68° C. | 4.48 | 86% | 2.81 | 53% |
| | 50° C./50% RH, 3 hrs. | avg. 5.21 | | avg 5.34 | |
| E-2 | no radiant heat exposure | 2.31 | 44% | 1.21 | 25% |
| | radiant heat at 81° C. | 4.08 | 78% | 4.25 | 82% |
| | 50° C./50% RH, 3 hrs. | avg. 5.22 | | avg. 5.20 | |
| E-2 | no radiant heat exposure | 2.26 | 43% | 1.21 | 23% |
| | radiant heat at 79° C. | 3.97 | 76% | 4.08 | 78% |
| | 50° C./50% RH, 3 hrs. | avg.5.22 | | avg. 5.20 | |

TABLE 2-continued

EFFECT OF RADIANT HEATING ON DYE CONVERSION RATE

| Receiver | Treatment | Cyan Channel | | Green Channel | |
|---|---|---|---|---|---|
| Elements | Description | R/G | % dye conv. | R/G | % dye conv. |
| E-2 | no radiant heat exposure | 2.21 | 42% | 1.21 | 23% |
| | radiant heat at 68° C. | 3.78 | 72% | 2.99 | 58% |
| | 50° C./50% RH, 3 hrs. | avg. 5.22 | | avg. 5.20 | |

*100% dye conversion assumed when receiver elements were incubated at 50 C./50% RH for 3 hrs.

[1]calculated red/green ratio for cyan channel without heat treatment

[2]calculated red/green ratio for cyan channel with radiant heat treatment. Receiver surface temperature reached 81° C.

[3]calculated red/green ratio for cyan channel after 3 hours incubation at 50° C./50% RH

[4][(R/G ratio, without heat treatment)/(R/G ratio, 3 hrs. incubation at 50° C./50% RH)] × 100 for cyan

[5][(R/G ratio, with radiant heat treatment at 81° C.)/(R/G ratio, 3 hrs. incubation at 50° C./50% RH)] × 100 for cyan The results shown in Table 2 demonstrate that the conversion rate of the transferred image dye in dye-receiving elements E-1 and E-2 was significantly improved by the application of radiant heat.

The invention has been described in detail with particular reference to preferred embodiments thereof, but it will be understood that variations and modifications can be effected within the spirit and scope of the invention.

What is claimed is:

1. A process of forming a dye transfer image comprising:

a) imagewise-heating a dye-donor element comprising a support having thereon a dye layer comprising a dye dispersed in a polymeric binder, said dye being a deprotonated cationic dye which is capable of being reprotonated to a cationic dye having a N–H group which is part of a conjugated system, b) imagewise transferring said dye to a dye image-receiving layer of a dye-receiver element which contains acid moieties capable of reprotonating said deprotonated cationic dye, and c) subjecting said dye-receiver element to heat of from about 50° C. to about 95° C. from a heat source immediately prior to, during, or after said imagewise transfer of said dye.

2. The process of claim 1 wherein a radiant heat source is employed which provides said heat.

3. The process of claim 1 wherein said dye image-receiving layer comprises a polyester, an acrylic polymer, a styrene polymer or a phenolic resin.

4. The process of claim 1 wherein said dye image-receiving layer comprises a polymer containing an organic acid moiety as part of the polymer chain.

5. The process of claim 4 wherein said organic acid comprises a sulfonic acid, a carboxylic acid, a phosphonic acid, a phosphoric acid or a phenol.

6. The process of claim 1 wherein said dye image-receiving layer contains a ballasted organic acid.

7. The process of claim 6 wherein said ballasted organic acid comprises a salicylic acid, a sulfonic acid, a carboxylic acid, a phosphonic acid, a phosphoric acid or a phenol.

8. The process of claim 1 wherein said dye image-receiving layer contains an inorganic acid or its salt.

9. The process of claim 8 wherein said inorganic acid is aluminum sulfate or zinc nitrate.

10. The process of claim 1 wherein said deprotonated cationic dye has the following formula:

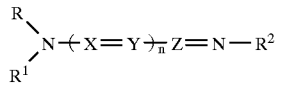

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or a substituted or unsubstituted alkyl group from about 1 to about 10 carbon atoms; and n is 0 to 11.

* * * * *